US010173853B2

(12) United States Patent
Fujinaka et al.

(10) Patent No.: US 10,173,853 B2
(45) Date of Patent: Jan. 8, 2019

(54) SHEET FEEDING APPARATUS AND IMAGE FORMING APPARATUS

(71) Applicant: CANON KABUSHIKI KAISHA, Tokyo (JP)

(72) Inventors: Koji Fujinaka, Chofu (JP); Fuyuto Yamashita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/629,075

(22) Filed: Jun. 21, 2017

(65) Prior Publication Data

US 2018/0002123 A1 Jan. 4, 2018

(30) Foreign Application Priority Data

Jun. 29, 2016 (JP) ..... 2016-129044
Jul. 22, 2016 (JP) ..... 2016-144639

(51) Int. Cl.

| | |
|---|---|
| ***B65H 3/06*** | (2006.01) |
| ***B65H 5/06*** | (2006.01) |
| ***B65H 1/14*** | (2006.01) |
| ***B65H 1/12*** | (2006.01) |
| *B65H 7/20* | (2006.01) |

(52) U.S. Cl.

CPC ..... *B65H 3/0684* (2013.01); *B65H 1/12* (2013.01); *B65H 1/14* (2013.01); *B65H 5/068* (2013.01); *B65H 3/0607* (2013.01); *B65H 7/20* (2013.01); *B65H 2403/512* (2013.01)

(58) Field of Classification Search

CPC ..... B65H 1/12; B65H 1/14; B65H 3/0684; B65H 2403/512

See application file for complete search history.

(56) References Cited

U.S. PATENT DOCUMENTS

| | | | | |
|---|---|---|---|---|
| 5,564,690 | A * | 10/1996 | Oshida | B65H 1/12 271/127 |
| 8,251,364 | B2 * | 8/2012 | Morinaga | B65H 1/12 271/157 |
| 9,851,675 | B2 * | 12/2017 | Takiguchi | G03G 15/6511 |
| 2012/0163857 | A1 * | 6/2012 | Kamimura | G03G 21/1633 399/110 |

FOREIGN PATENT DOCUMENTS

JP 2008-15077 A 1/2008

* cited by examiner

*Primary Examiner* — Howard J Sanders
(74) *Attorney, Agent, or Firm* — Canon U.S.A., Inc. IP Division

(57) ABSTRACT

A feeding apparatus includes a sheet supporting member, a feeding member, and a lift unit. The lift unit lifts and lowers the sheet supporting member to abut a sheet stacked on the sheet supporting member against the feeding member. The lift unit includes an urging member that biases the sheet supporting member towards the feeding member, a moving member that moves in a first direction different from a sheet supporting member lifting direction, and a contact member in contact with the moving member. The contact member includes a curved cam surface in a region that comes in contact with the moving member. A contact state between the moving member and the contact member is changed by moving the moving member in the first direction and the curved cam surface. Regarding changing the contact state, the sheet supporting member can be moved to a feed position and a retracted position.

18 Claims, 21 Drawing Sheets

SHEET FEEDING APPARATUS AND IMAGE FORMING APPARATUS

BACKGROUND OF THE INVENTION

Field of the Invention

The present disclosure relates to image forming apparatuses, such as a copier, a printer, a facsimile machine, and a multifunction apparatus, which form an image with an electrophotographic method.

Description of the Related Art

Hitherto, in image forming apparatuses, such as a copier, a printer, and a facsimile, apparatuses in which an image is formed by feeding a sheet to an image forming unit from a sheet feeding apparatus are widely used. Note that a typical sheet feeding apparatus is an apparatus in which a sheet feeding cassette that is a sheet storage unit is detachably mounted in a main body of the apparatus, and in which the sheet contained in the sheet feeding cassette is automatically fed to the image forming unit.

Note that there is a sheet feeding cassette in Japanese Patent Laid-Open No. 2008-15077 provided with a sheet supporting member, which is capable of being lifted and lowered, on which sheets are stacked, and that is lifted when the sheets are fed such that the stacked sheets are pressed against a feed roller, for example. Furthermore, when feeding the sheet, the feed roller is rotated, and the sheets that are pressed down with the sheet supporting member are, from the uppermost sheet, sequentially fed to the image forming unit.

Note that in such a sheet feeding apparatus, the sheet supporting member is lifted and lowered with a cam provided coaxial with the feed roller. Furthermore, during a standby period when the sheets are not fed, the sheet supporting member is pushed down to a certain position with the cam so that setting of the sheet and replacement can be facilitated.

However, in such a sheet feeding apparatus configured in the above manner, the sheet supporting member needs to be moved up and down once in a reciprocating manner per each rotation of the drive shaft; accordingly, reduction in size (reduction in the outermost diameter) of the cam is disadvantageously difficult. For example, in a case in which the sheet supporting member is provided in a pivotal manner in the up-down direction, when the size of the cam is reduced, the pivot angle of the sheet supporting member becomes small, and the distance at which the feed roller and the sheet supporting member are spaced away from each other becomes small.

Furthermore, when the distance at which the feed roller and the sheet supporting member are spaced away from each other is reduced, the amount of sheets stacked on the sheet supporting member becomes disadvantageously small. As a result, the user needs to replenish the sheets frequently, such that ease of operation is disadvantageously hindered. As described above, since the size of the cam and the pivot angle of the sheet supporting member are in a tradeoff relationship, miniaturization of the cam is difficult.

SUMMARY OF THE INVENTION

Accordingly, the present disclosure provides a sheet feeding apparatus and an image forming apparatus, which achieves miniaturization by lifting and lowering the sheet supporting member without providing a cam coaxial with the feed roller. For example, a cam follower provided in a lift plate includes a curved cam surface. Change in states in which the curved cam surface and a slider are in contact with each other enables the lift plate to move to a feed position and to a retracted position.

According to an aspect of the present invention, a sheet feeding apparatus includes a sheet supporting member to support a sheet and is configured to be lifted and lowered, a feeding member to feed the sheet stacked on the sheet supporting member, and a lift unit to lift and lower the sheet supporting member such that the sheet stacked on the sheet supporting member is abutted against the feeding member, wherein the lift unit includes an urging member that biases the sheet supporting member towards the feeding member, a moving member that, with respect to the sheet supporting member, moves in a first direction that is a direction different from a lifting direction of the sheet supporting member, and a contact member that is supported by the sheet supporting member and is in contact with the moving member, wherein the contact member includes a curved cam surface in a region that comes in contact with the moving member, wherein a contact state between the moving member and the contact member is changed by a movement of the moving member in the first direction and the curved cam surface, and wherein owing to the change in the contact state, the sheet supporting member is capable of moving to a feed position in which the sheet stacked on the sheet supporting member is abutted against the feeding member with the urging member, and moving to a retracted position in which the sheet supporting member countering an urging force of the urging member is retreated more from the feeding member with respect to the feed position.

Further features of the present invention will become apparent from the following description of embodiments with reference to the attached drawings.

DESCRIPTION OF THE EMBODIMENTS

Figure 1:
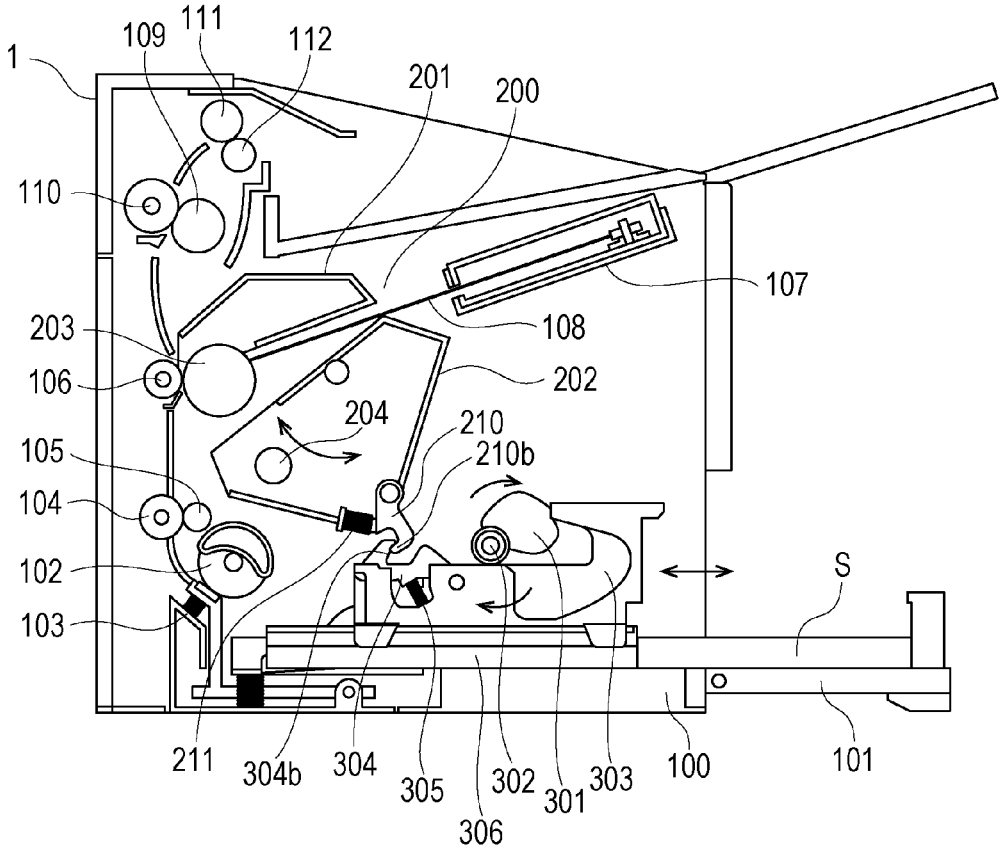
FIG. 1 is a schematic cross-sectional view illustrating an image forming apparatus according to the present disclosure.

Hereinafter, referring to the drawings, embodiments of the disclosure will be exemplified in detail. Note that the dimensions, the materials, and the shapes of the components, the relative configuration of the components, and the like that are described in the following embodiments are to be appropriately altered based on the configuration of the device to which the present disclosure is applied and on various conditions, and the scope of the present disclosure is not intended to be limited by the following embodiments.

First Embodiment

Image Forming Apparatus

FIG. 1 is a schematic cross-sectional view of an image forming apparatus that is an example of an image forming apparatus including a sheet feeding apparatus according to a first embodiment of the present disclosure. The image forming apparatus according to the present embodiment is a laser printer employing an electrophotographic method. Referring to FIG. 1, reference numeral 1 is a printer body, reference numeral 200 is a cartridge serving as an image forming unit that is provided in the printer body 1 and that forms an image using an electrophotographic method, and reference numeral 100 is a sheet feeding apparatus that feeds a sheet S to the image forming unit 200.

The sheet feeding apparatus 100 includes a feed cassette 101 on which the sheets S are stacked, a feed roller 102 serving as a feeding member that feeds the sheets S stacked on the feed cassette 101, and a lift plate 307 serving as a sheet supporting member that supports the sheets. In a state in which the lift plate 307 is positioned at a feed position that is a position in which the sheets stacked on the lift plate 307 are abutted against the feed roller 102, the sheets S are fed with the feed roller 102. Note that the sheet S is a recording medium, such as paper or glossy paper.

The sheets S stacked on the feed cassette 101 are sent out by rotating the feed roller 102 that is in pressure contact with the sheets S. Furthermore, the sheets S that have been sent out in the above manner are separated, sheet by sheet, with a separating member 103.

The separated sheet S is conveyed to a pair of conveyance rollers that include a conveyance roller 104 and a conveyance idler roller 105 that opposes the conveyance roller 104, and is conveyed towards the cartridge 200 serving as the image forming unit.

The cartridge 200 includes a process cartridge 201 and a developing cartridge 202. The process cartridge 201 includes a photosensitive drum 203 and a charger. Meanwhile, the developing cartridge 202 includes a developing device including a developing roller 204 (a developing member), and a toner container. The process cartridge 201 and the developing cartridge 202 are detachable from the printer body 1.

In the cartridge 200, a surface of the photosensitive drum 203 is charged in a uniform manner with the charger, and a laser beam 108 is, in accordance with image information, scanned on the photosensitive drum 203 with a laser scanner 107, such that an electrostatic latent image is formed. The latent image that has been formed is developed into a toner image with the developing device, and the toner image is transferred onto the conveyed sheet S at a portion between the photosensitive drum 203 and a transfer roller 106. The sheet S on which the image has been transferred is conveyed to a fixing roller 109 and a pressure roller 110.

The fixing roller 109 includes therein a heat source, and fixes the toner image on the sheet S by performing a heating and compressing process at a nip formed together with the pressure roller 110. The sheet S on which the image has been formed is discharged and stacked outside the apparatus with a pair of discharge rollers formed of a discharge roller 111 and a discharge idler roller 112 opposing the discharge roller 111.

Figure 2:
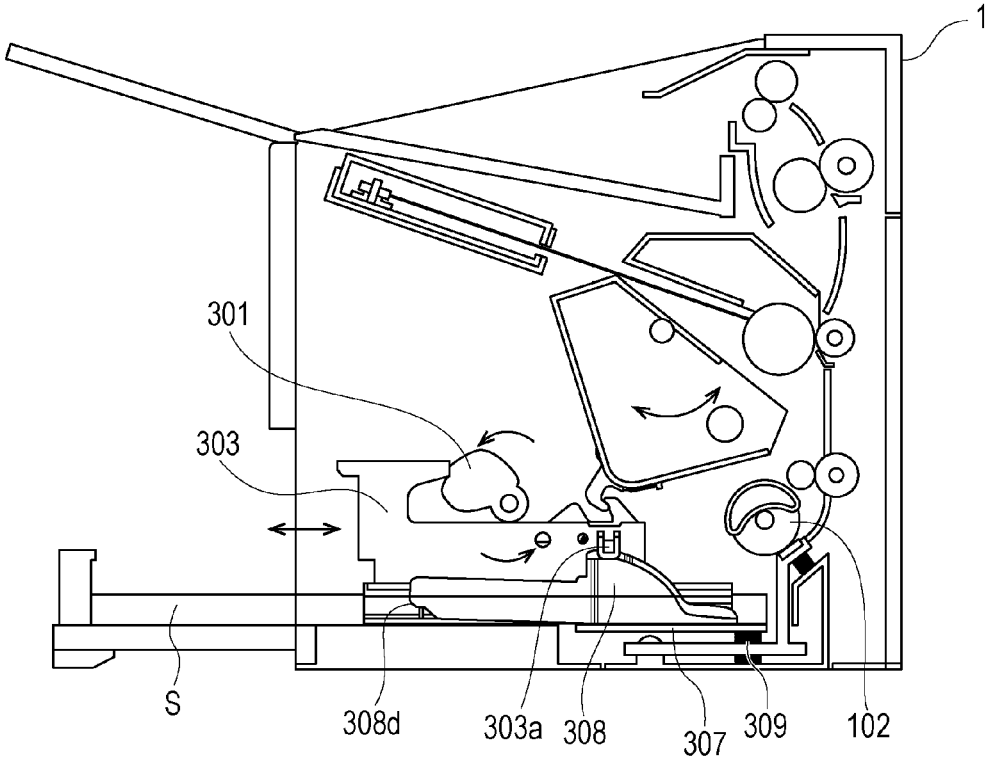
FIG. 2 is a schematic cross-sectional view of the image forming apparatus illustrated in FIG. 1 viewed from the opposite side.

Furthermore, the printer body 1 includes therein a control unit (not shown) including a power supply and electric components that drive and control the components. Abutting and separating mechanism of developing member Abutting and separating operation between the developing roller 204 and the photosensitive drum 203 of the cartridge 200 will be described next. FIG. 2 is a schematic cross-sectional view of the printer body 1 in FIG. 1 viewed from a side opposite the side viewed in FIG. 1.

The developing cartridge 202 is provided to be pivotal with respect to the process cartridge 201, and is biased in the clockwise direction in FIG. 2 with an urging member (not shown). Furthermore, the abutting and separating mechanism is capable of switching between two states, namely, an abutted state in which the photosensitive drum 203 of the process cartridge 201 and the developing roller 204 of the developing cartridge 202 are abutted against each other, and a separated state in which the photosensitive drum 203 and the developing roller 204 are separated from each other.

Separation cams 301 serving as separation members are supported by the printer body 1 about a separation cam shaft 302 in a rotatable manner. Sliders 303 serving as moving members that move to follow the separation cams 301 are provided. The sliders 303 guided by slider guides 306 serving as guiding members are held to be slidable and movable in a horizontal direction. Slider pawls 304 serving as first locking members are disposed in the sliders 303 in a pivotal manner with respect to the sliders 303.

Each slider pawl 304 is biased with a slider pawl spring 305 serving as a first urging member. Each slider pawl 304 engages with a cartridge pawl 210 serving as a second locking member of the developing cartridge 202. Each cartridge pawl 210 is attached to the developing cartridge 202 in a rotatable manner, and is biased with a cartridge spring 211 serving as a second urging member.

Each slider pawl 304 and the corresponding cartridge pawl 210 include a first lock portion 304*a* and a second lock portion 210*a*, respectively, that engage with each other while the cartridge 200 is in the abutted state. Furthermore, each slider pawl 304 and the corresponding cartridge pawl 210 include a first separation portion 304*b* and a second separation portion 210*b*, respectively, that abut against each other while the cartridge 200 is in the separated state.

Figure 3A:
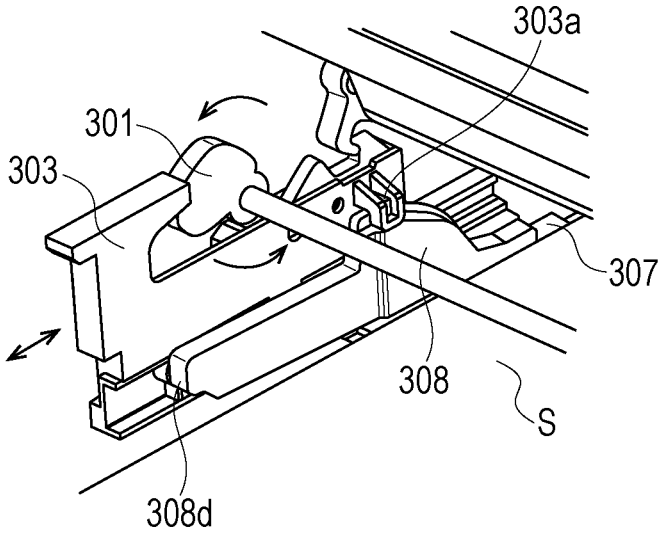
FIG. 3A is a perspective view of a lift mechanism according to a first embodiment viewed from the inside.
Figure 3B:
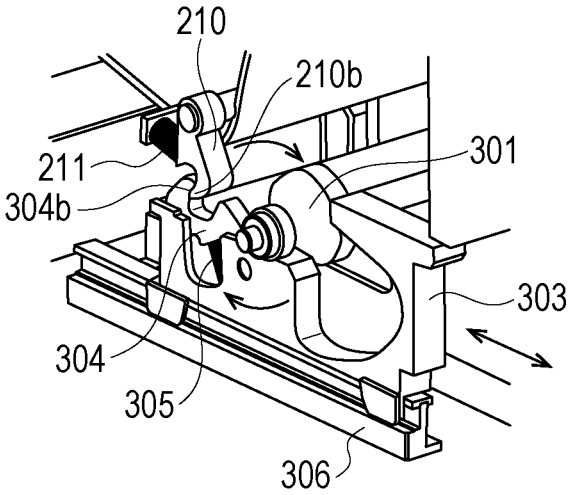
FIG. 3B is a perspective view of a lift unit illustrated in FIG. 3A viewed from the opposite side (from the outside).

Referring to FIGS. 3B, 1, 4B, 5, 7B, and 8, the abutting and separating operation of the cartridge 200 will be described. FIGS. 3B and 1 illustrates the cartridge 200 in the separated state, FIGS. 4B and 5 an intermediate state, and FIGS. 7B and 8 the abutted state.

Figure 4B:
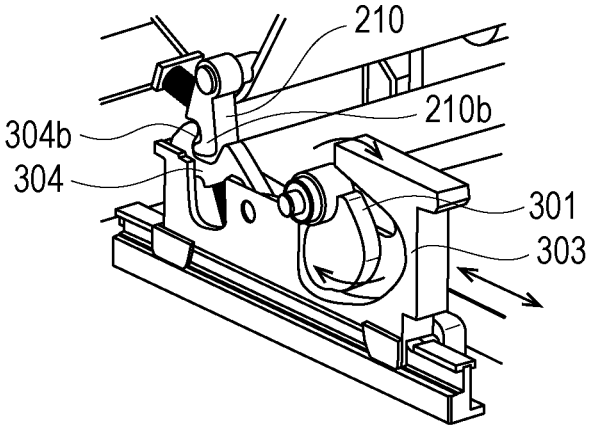
FIG. 4B is a perspective view of the lift unit illustrated in FIG. 4A viewed from the opposite side (from the outside).
Figure 5:
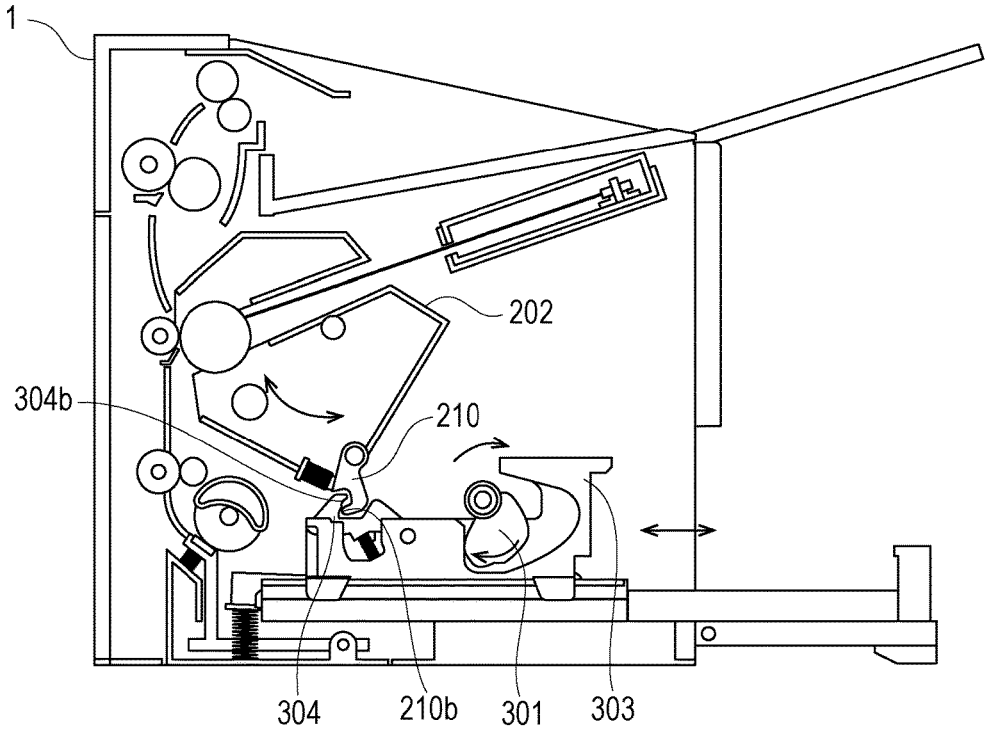
FIG. 5 is a schematic cross-sectional view illustrating an image forming apparatus according to the present disclosure.

As illustrated in FIGS. 3B and 1, during a standby period when no printing operation is performed, the cartridge 200 is in the separated state. When the separation cams 301 rotate in the arrow direction in such a state, the sliders 303 interlocking with the separation cams 301 slide. As illustrated in FIGS. 4B and 5, the developing cartridge 202 pivots in an abutting direction while the first separation portions 304*b* of the slider pawls 304 provided in the sliders 303, and the second separation portions 210*b* of the cartridge pawls 210 provided in the developing cartridge 202 abut against each other.

When the separation cams 301 rotate further, the sliders 303 interlocking with the separation cams 301 slide. In the course of the above, the first separation portions 304*b* of the slider pawls 304 provided in the sliders 303 and the second separation portions 210*b* of the cartridge pawls 210 provided in the developing cartridge 202 are separated from each other and the pivoting of the developing cartridge 202 ends.

Figure 7A:
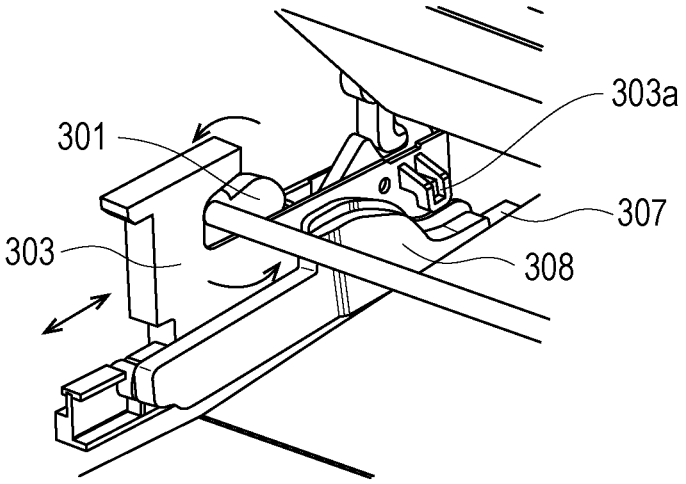
FIG. 7A is a perspective view of the lift mechanism according to the first embodiment viewed from the inside.
Figure 7B:
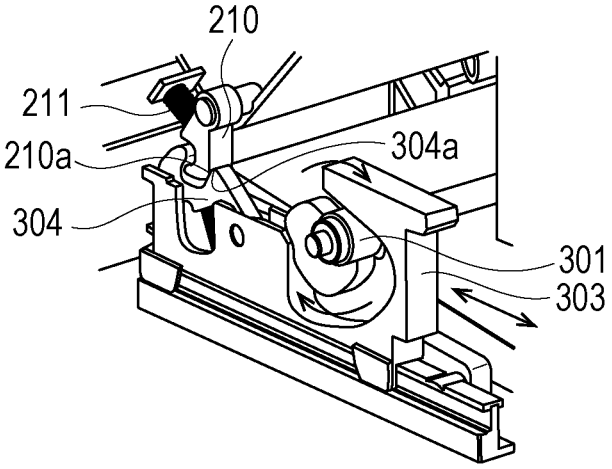
FIG. 7B is a perspective view of the lift unit illustrated in FIG. 7A viewed from the opposite side (from the outside).
Figure 8:
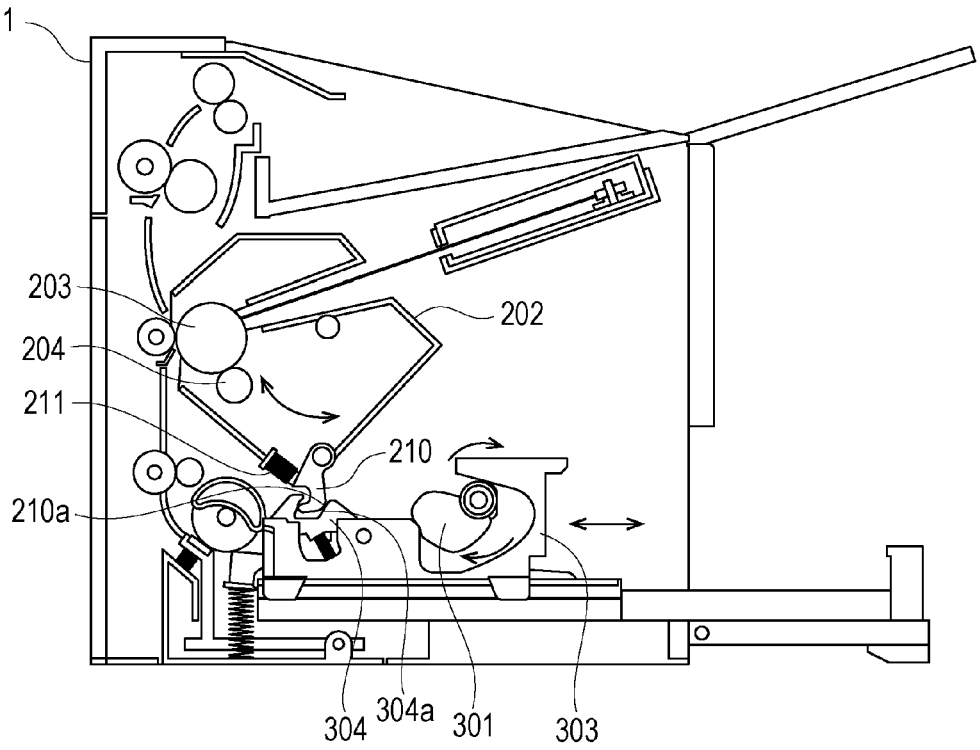
FIG. 8 is a schematic cross-sectional view illustrating an image forming apparatus according to the present disclosure.

Subsequently, as illustrated in FIGS. 7B and 8, the separation cams 301 rotate until the abutted state is reached. Upon rotation of the separation cams 301, the sliders 303 slide further, and the first lock portions 304*a* of the slider pawls 304 provided in the sliders 303 press the cartridge pawl contact surfaces 210*a* of the cartridge pawls 210 provided in the developing cartridge 202. Contact pressure is applied between the developing roller 204 and the photosensitive drum 203 with the cartridge springs 211 biasing the cartridge pawls 210. The above state is the abutted state.

Upon half a rotation of the separation cams 301 in the arrow direction from the abutted state in FIGS. 7B and 8, the sliders 303 interlocking with the separation cams 301 slide. The first separation portions 304*b* of the slider pawls 304 provided in the sliders 303 and the second separation portions 210*b* of the cartridge pawls 210 provided in the developing cartridge 202 are abutted against each other and the developing cartridge 202 is pivoted. By having the rotation of the separation cams 301 end and by having the sliders 303 stop, the pivoting of the developing cartridge 202 is stopped and the separation between the developing roller 204 and the photosensitive drum 203 is maintained. The above state is the separated state in FIGS. 3B and 1.

As described above, in the present embodiment, the developing roller 204 and the photosensitive drum 203 are abutted against or separated from each other by having the sliders 303 provided with the abutting and separating mechanism be moved in the horizontal direction to change the abutted state between the developing cartridge 202 and the sliders 303.

Lift Unit of Sheet Feeding Apparatus

Referring next to FIGS. 3A and 2, a lift unit of the sheet feeding apparatus 100 will be described. The lift unit includes at least the slider 303 that is a portion of the abutting and separating mechanism, and a cam follower 308 that is a contact member in contact with the moving slider 303.

The lift plate 307 serving as the sheet supporting member is provided in a pivotal manner with respect to the printer body 1 about a rotational center 308*d* of the cam follower 308. The lift plate 307 is biased with a lift plate spring 309 serving as a third urging member in a direction in which the sheets stacked on the lift plate 307 abut against the feed roller 102. The slider 303 serving as a slide member is slid against the lift plate 307 with the separation cam 301.

The slider 303 includes a slider cam 303*a* serving as an action portion that acts on the cam follower 308. The position of the slider cam 303*a* in the lifting direction does not change regardless of the sliding motion of the slider 303. The slider cam 303*a* moves in a space upstream of the feed roller 102 in a sheet feeding direction of the feed roller 102.

In the present embodiment, the cam follower 308 is supported by the lift plate 307, and is lifted and lowered in an integrated manner together with the lift plate 307. The lift unit of the present embodiment includes the lift plate spring 309 described above, the slider 303 including the slider cam 303*a*, and the cam follower 308. Furthermore, the cam follower 308 includes a cam surface 308*a* that is a curved cam surface in contact with the slider cam 303*a*.

Figure 4A:
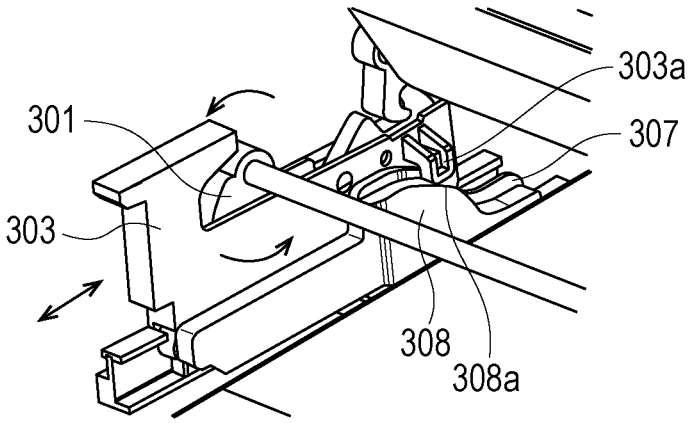
FIG. 4A is a perspective view of the lift mechanism according to the first embodiment viewed from the inside.
Figure 6:
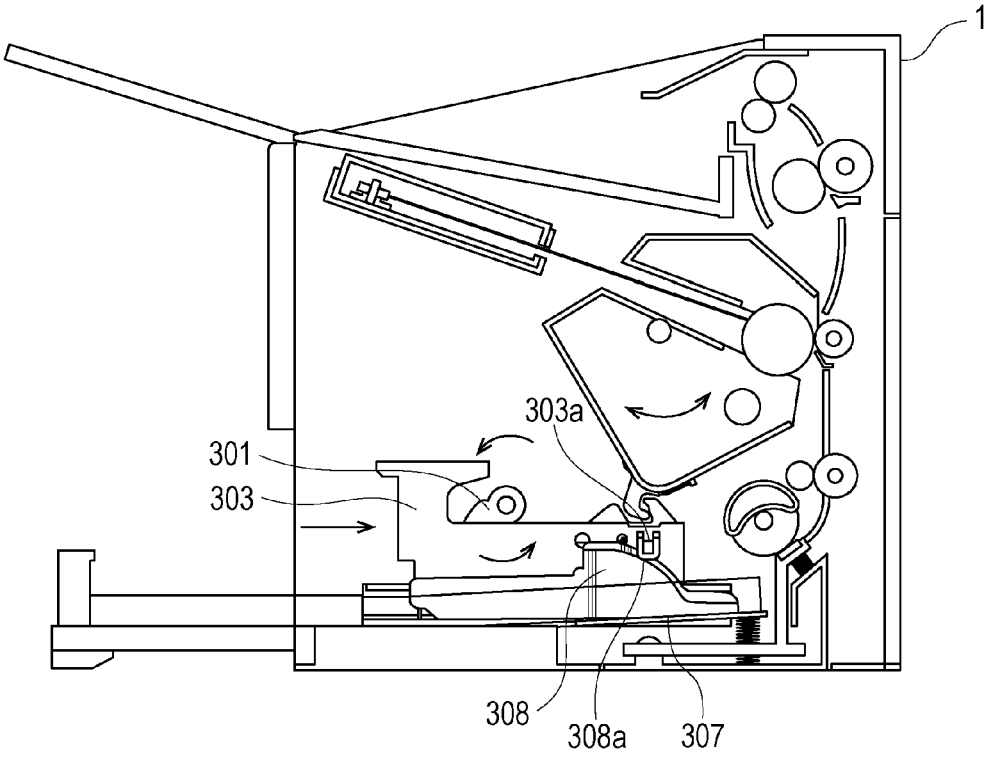
FIG. 6 is a schematic cross-sectional view of the image forming apparatus illustrated in FIG. 5 viewed from the opposite side.
Figure 9:
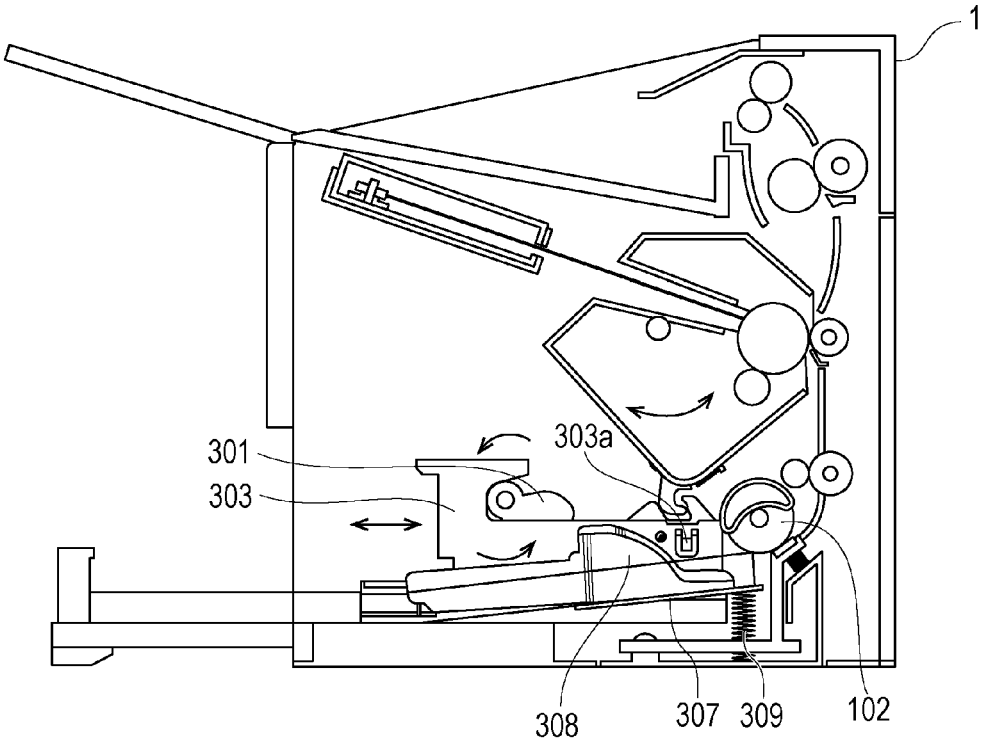
FIG. 9 is a schematic cross-sectional view of the image forming apparatus illustrated in FIG. 8 viewed from the opposite side.

Referring to FIGS. 3A, 2, 4A, 6, 7A, and 9, a sheet feeding operation will be described. FIGS. 3A and 2 illustrate a state in which the lift plate 307 is positioned at a retracted position that is a position more retracted from the feed position with respect to the feed roller 102 so that the feed roller 102 is separated from the sheets stacked on the lift plate 307. FIGS. 4A and 6 illustrate a state in which the lift plate 307 is positioned at an intermediate position between the retracted position and the feed position, and FIGS. 7A and 9 illustrate a state in which the lift plate 307 is positioned at the feed position that is a position where the sheets stacked on the lift plate 307 is in pressure contact with the feed roller 102.

As illustrated in FIGS. 3A and 2, in the retracted position, the slider cam 303*a* provided in the slider 303 counters the urging force of the lift plate spring 309 and presses the cam follower 308, such that the uppermost sheet stacked on the lift plate 307 is spaced away from the feed roller 102. In the above state, when the separation cam 301 rotates, the slider 303 interlocking with the separation cam 301 slides. As illustrated in FIGS. 4A and 6, since the slider cam 303*a* provided in the slider 303 slides as well, the lift plate 307 pivots along the curved surface of the cam surface 308*a* of the cam follower 308.

When the separation cams 301 rotate further, the sliders 303 interlocking with the separation cams 301 slide. As illustrated in FIGS. 7A and 9, when the slider 303 moves to an end portion, the slider cam 303*a* and the cam follower 308 are spaced away from each other, and the pressing pressure of the lift plate 307 is released. As a result, the upper most sheet stacked on the lift plate 307 biased by the lift plate spring 309 comes into contact with the feed roller 102, such that a feedable feed position is reached. In other words, the cam surface 308*a* and the slider cam 303*a* are retreated from the feed roller 102 when the lift plate 307 is positioned at the feed position.

Upon half a rotation of the separation cam 301 in the arrow direction from the feed position in FIGS. 7A and 9, the slider 303 interlocking with the separation cam 301 slides. The slider cam 303*a* countering the urging force of the lift plate spring 309 presses the cam follower 308, and the uppermost sheet stacked on the lift plate 307 is spaced away from the feed roller 102, such that the lift plate 307 is positioned at the retracted position illustrated in FIGS. 3A and 2.

As described above, the sliders 303 are capable of performing a sliding motion in the lifting direction (the vertical direction in FIGS. 1 and 2) of the lift plate 307 in the space formed by the lift plate 307 and the feed roller 102.

In the present embodiment, since the lift plate 307 is lifted and lowered by changing the state in which the slider cam 303*a* of the slider 303 and the cam surface 308*a* are in contact with each other, the apparatus cam be made smaller compared to a configuration in which the above is performed by a cam provided to be coaxial with the axis of rotation of a feed roller. In a case in which the pivoting operation of the lift plate 307 is performed using the cam that is coaxial with the axis of rotation of the feed roller, if the amount of sheets on the sheet feeding cassette were to be increased, a large cam will be required, and the sheet feeding apparatus 100 will become large in size. For example, by providing a large cam, the distance between the feed roller 102 and the conveyance roller 104 becomes large and the sheet feeding apparatus 100 becomes large in size.

Assuming that conditions such as the amount of stacked sheet on the sheet feeding cassette and the pivot angle of the lift plate 307 needed for such an amount are the same, compared with conventional configurations, the configuration of the present embodiment does not need a space where the cam coaxial with the axis of rotation of the feed roller operates, such that the size of the body in the height direction in particular can be reduced. Furthermore, as illustrated in FIGS. 1 and 2, and other figures, the region in which the sliders 303 perform the sliding motion is the space formed by the cartridge 200 and the lift plate 307, which is a space sufficient enough to dispose the sliders 303. Accordingly, a special space for disposing the sliders 303 is not required, and the printer body 1 defining the overall image forming apparatus can be prevented from becoming large in size.

Figure 10A:
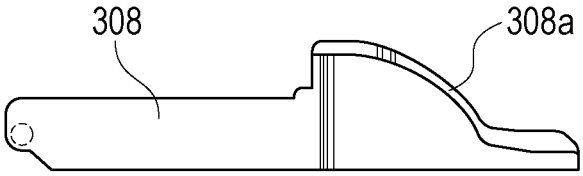
FIG. 10A is a side view illustrating a curved cam surface of a cam follower according to the first embodiment.
Figure 10B:
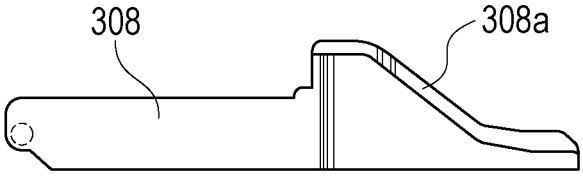
FIG. 10B is a side view illustrating a flat cam surface of a cam follower according to the first embodiment.

Furthermore, in the present embodiment, while the cam surface 308*a* of the cam follower 308 is a curved surface as illustrated in FIG. 10A, as illustrated in FIG. 10B, the cam surface 308*a* of the cam follower 308 may be a flat surface. By changing the shape of the cam surface 308*a*, the pivoting speed of the lift plate 307 can be changed and the lift plate 307 can be slowly moved such that noise can be reduced.

Second Embodiment

In the first embodiment, a configuration has been described in which the cam surface is provided on a cam follower 308 that is in contact with the slider 303. A second embodiment is configured such that a cam surface is provided on a slider cam 313*a* that is an action portion of a slider 313. Note that other configurations are similar to those of the printer body 1 and the sheet feeding apparatus 100 of the first embodiment; accordingly, a description will be given while similar portions are denoted with similar reference numerals.

Figure 11A:
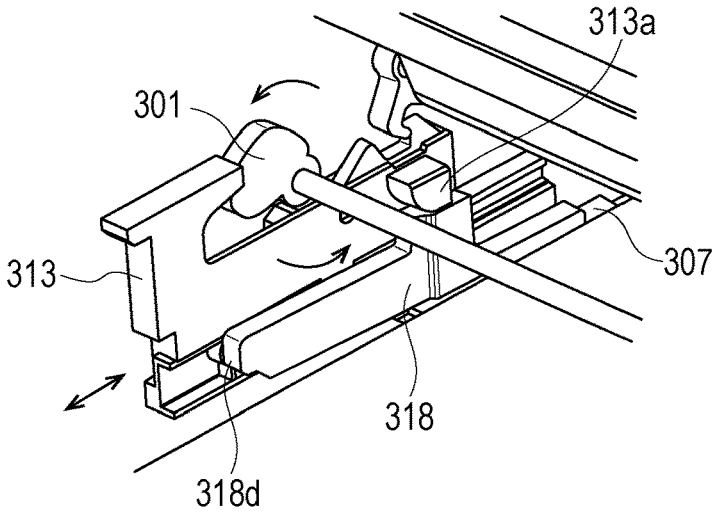
FIG. 11A is a perspective view illustrating a lift mechanism according to a second embodiment.
Figure 11B:
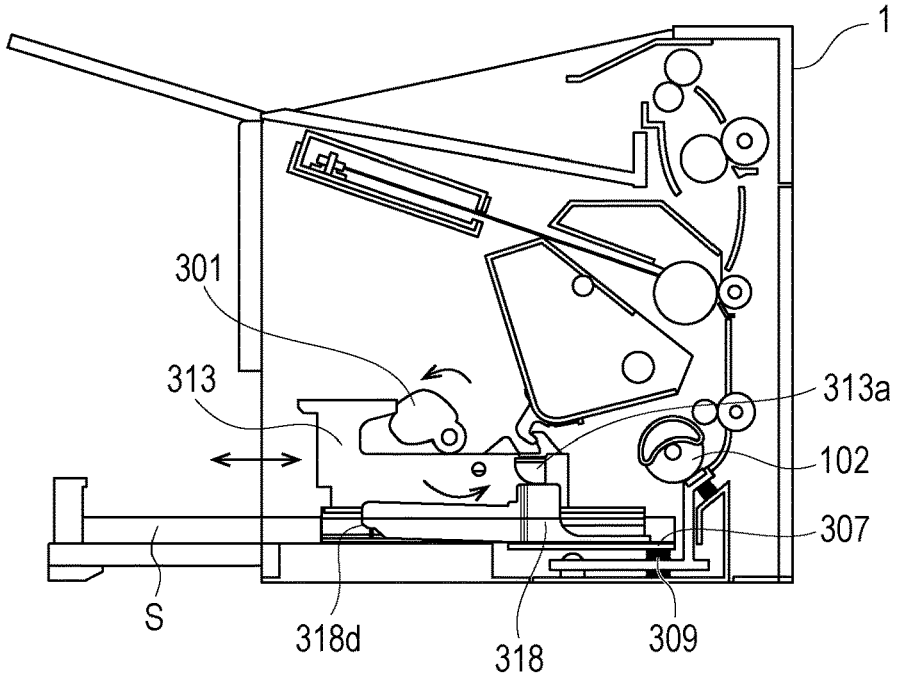
FIG. 11B is a cross-sectional view of an image forming apparatus according to the second embodiment viewed from the opposite side.
Figure 12A:
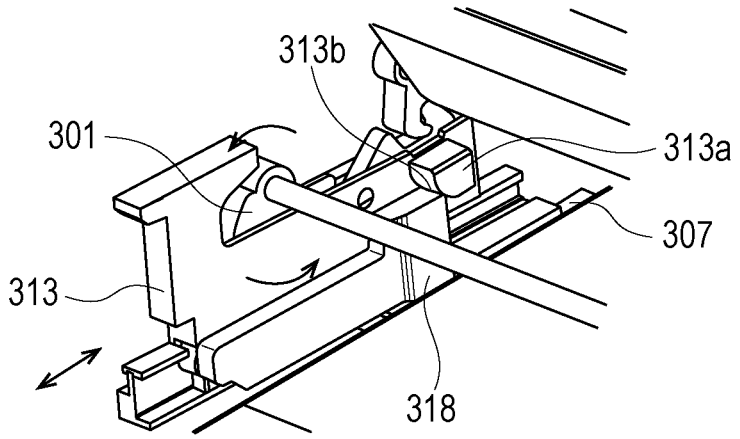
FIG. 12A is a perspective view illustrating the lift mechanism according to the second embodiment.
Figure 12B:
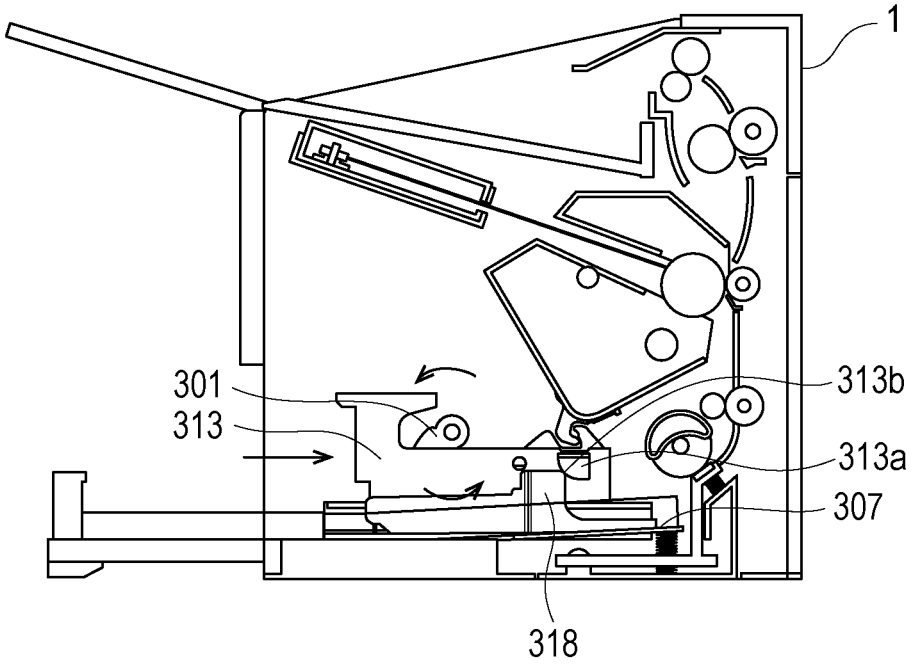
FIG. 12B is a cross-sectional view of the image forming apparatus according to the second embodiment viewed from the opposite side.
Figure 13A:
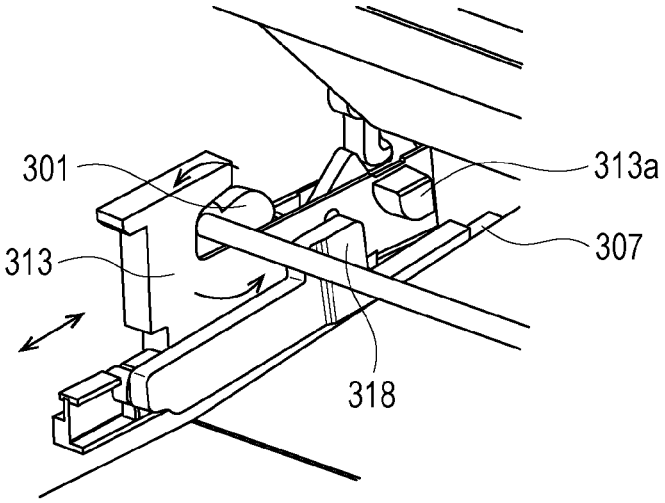
FIG. 13A is a perspective view illustrating the lift mechanism according to the second embodiment.
Figure 13B:
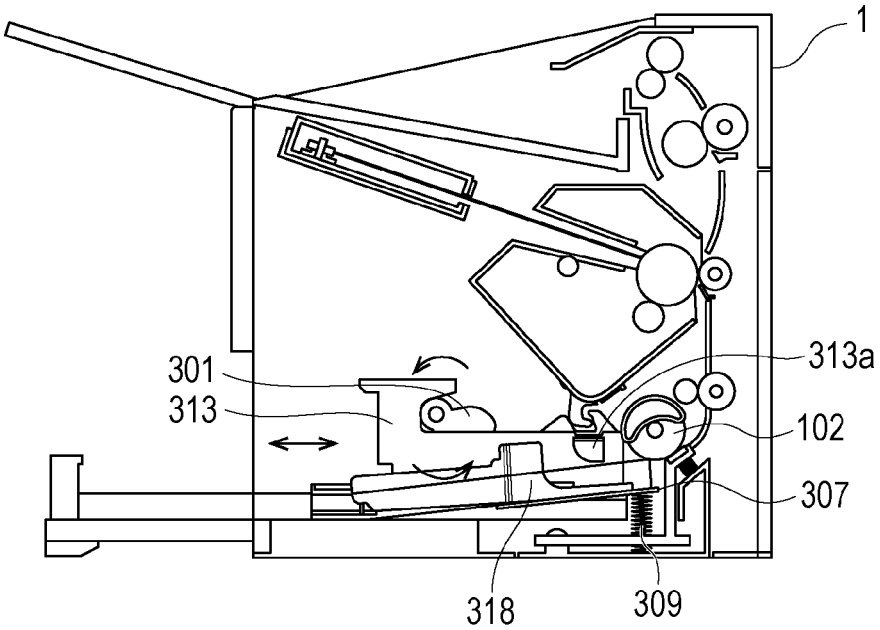
FIG. 13B is a cross-sectional view of the image forming apparatus according to the second embodiment viewed from the opposite side.

Referring to FIGS. 11A and 11B, a relationship between the slider cam 313*a* and a cam follower 318 of the second embodiment will be described. Only the external form of the sheets S is illustrated so that the shape of the cam follower 318 can be seen.

The lift plate 307 serving as the sheet supporting member is provided in a pivotal manner with respect to the printer body 1 about a rotational center 318*d* of the cam follower 318. The lift plate 307 is biased with the lift plate spring 309 serving as an urging member in a direction in which the sheets stacked on the lift plate 307 come in contact with the feed roller 102. The slider 313 serving as a slide member is slid against the lift plate 307 with the separation cam 301. The slider 313 includes a slider cam 313*a* provided with a cam shape. Furthermore, the lift plate 307 is provided with the cam follower 318 that is a contact member. The lift unit includes the lift plate spring 309 described above, the slider 313 including the slider cam 313*a*, and the cam follower 318.

Figure 19:
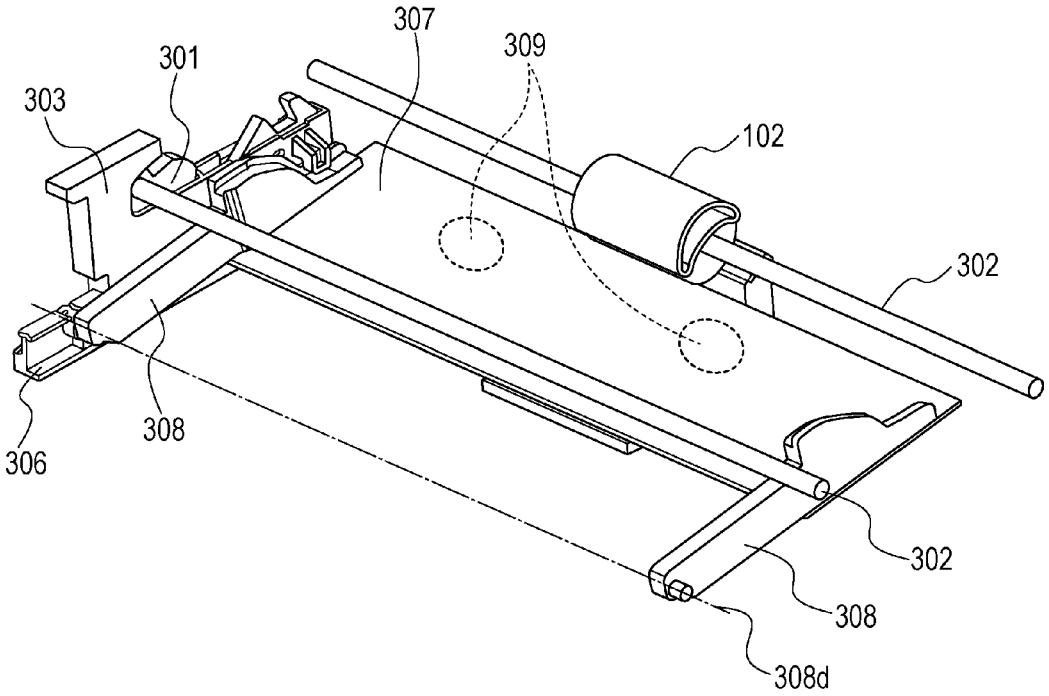
FIG. 19 is a perspective view illustrating a feed position of the sheet supporting member.

A sheet feeding operation will be described next. FIGS. 11A and 11B illustrates a state in which the lift plate 307 is positioned at the retracted position, FIG. 19 illustrates a state in which the lift plate 307 is positioned at an intermediate position between the retracted position and the feed position, and FIG. 20 illustrates a state in which the lift plate 307 is positioned at the feed position.

As illustrated in FIGS. 11A and 11B, in the retracted position, the slider cam 313*a* provided in the slider 313 counters the urging force of the lift plate spring 309 and presses the cam follower 318, such that the uppermost sheet stacked on the lift plate 307 is spaced away from the feed roller 102. In the above state, when the separation cam 301 rotates, the slider 313 interlocking with the separation cam 301 slides. As illustrated in FIG. 19, since the slider cam 313*a* provided in the slider 313 slides as well, the cam follower 318 provided in the lift plate 307 pivots along the curved surface of a cam surface 313*b* of the slider cam 313*a*.

When the separation cam 301 rotates further, the slider 313 interlocking with the separation cam 301 slides. As illustrated in FIG. 20, when the slider 313 moves to an end portion, the slider cam 313*a* and the cam follower 318 are not abutted against each other, and the pressing pressure of the lift plate 307 is released. As a result, the upper most sheet stacked on the lift plate 307 biased by the lift plate spring 309 comes into contact with the feed roller 102, such that a feedable feed position is reached.

Figure 20:
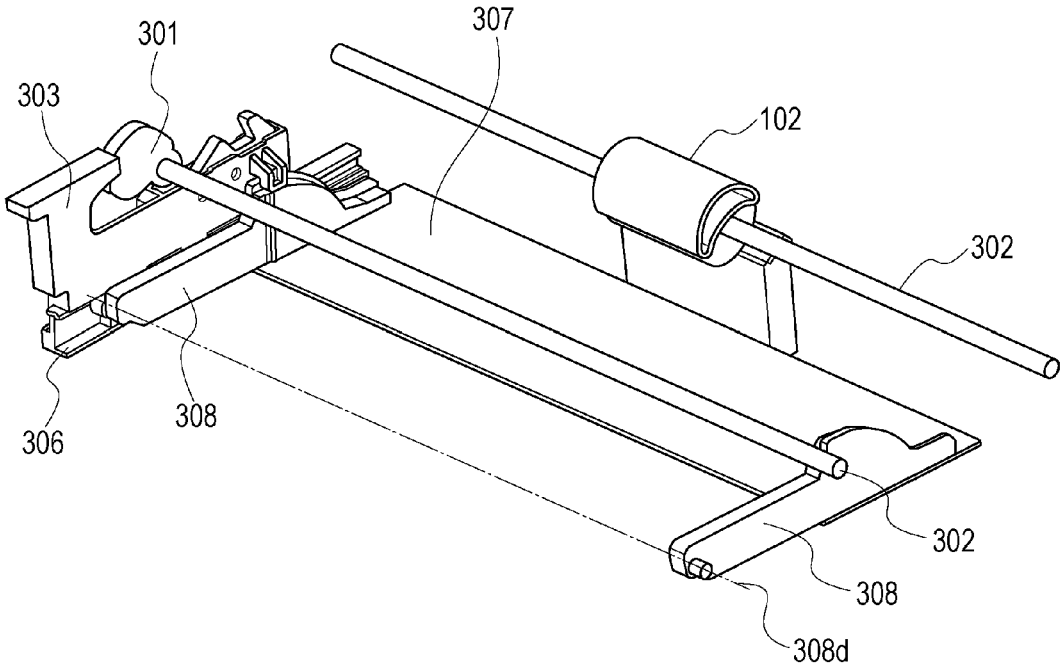
FIG. 20 is a perspective view illustrating a retracted position of the sheet supporting member.
Figure 21A:
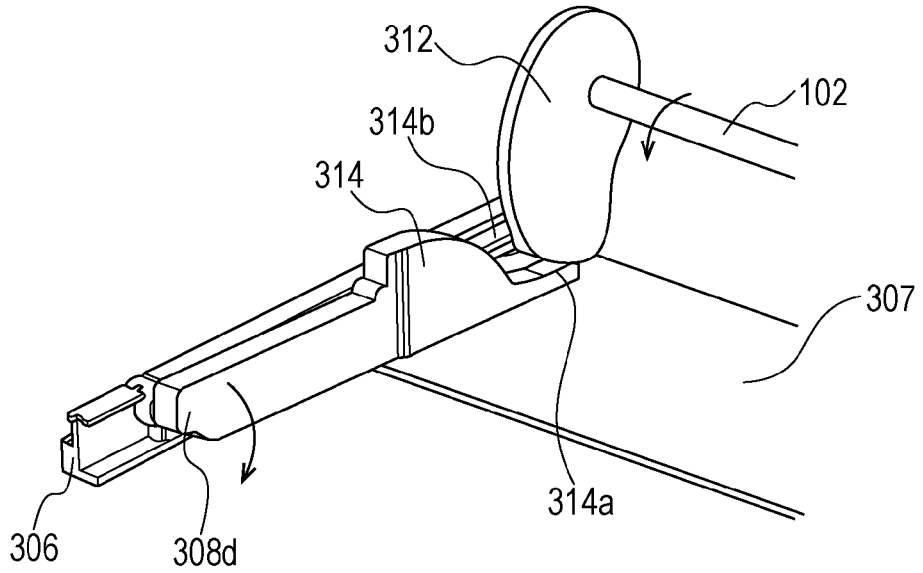
FIG. 21A is a perspective view of a lift mechanism according to another embodiment viewed from the inside.
Figure 21B:
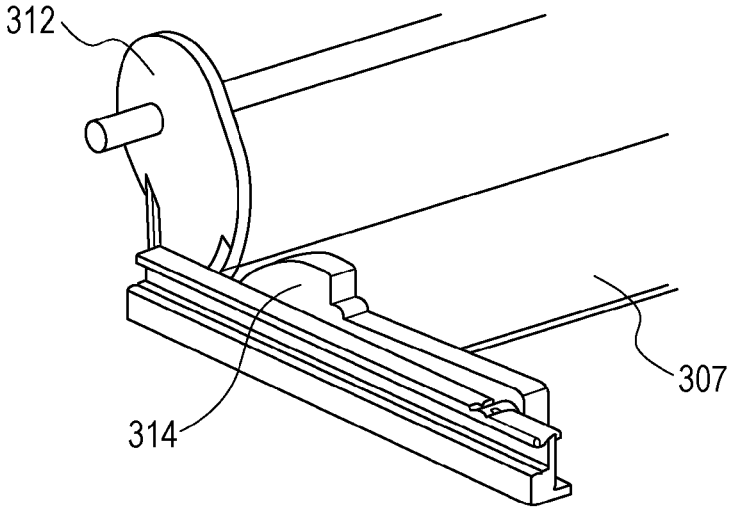
FIG. 21B is a perspective view of the lift member illustrated in FIG. 21A viewed from the opposite side (from the outside).

Upon half a rotation of the separation cam 301 in the arrow direction from the feed position in FIG. 20, the slider 313 interlocking with the separation cam 301 slides. The slider cam 313*a* countering the urging force of the lift plate spring 309 presses the cam follower 318, and the uppermost sheet stacked on the lift plate 307 is spaced away from the feed roller 102, such that the retracted position illustrated in FIGS. 11A and 11B is reached.

Figure 14A:
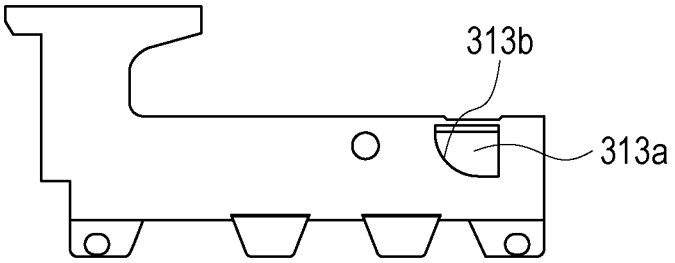
FIG. 14A is a side view illustrating a curved cam surface of a cam follower according to the second embodiment.
Figure 14B:
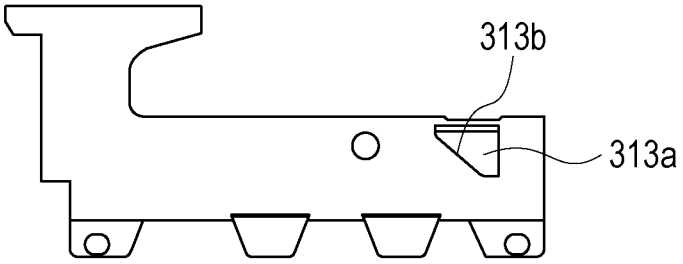
FIG. 14B is a side view illustrating a flat cam surface of a cam follower according to the second embodiment.

In the present embodiment as well, similar to the first embodiment, reduction in size of the sheet feeding apparatus 100 and that of the printer body 1 can be made. Furthermore, while the cam surface 313*b* of the slider cam 313*a* is a curved surface as illustrated in FIG. 14A, as illustrated in FIG. 14B, the cam surface 313*b* of the slider cam 313*a* may be a flat surface. By changing the shape of the cam surface 313*b*, the pivoting speed of the lift plate 307 can be changed and the lift plate 307 can be slowly moved such that noise can be reduced.

As another embodiment, positioning of the lift plate 307 in the width direction will be described.

Figure 15A:
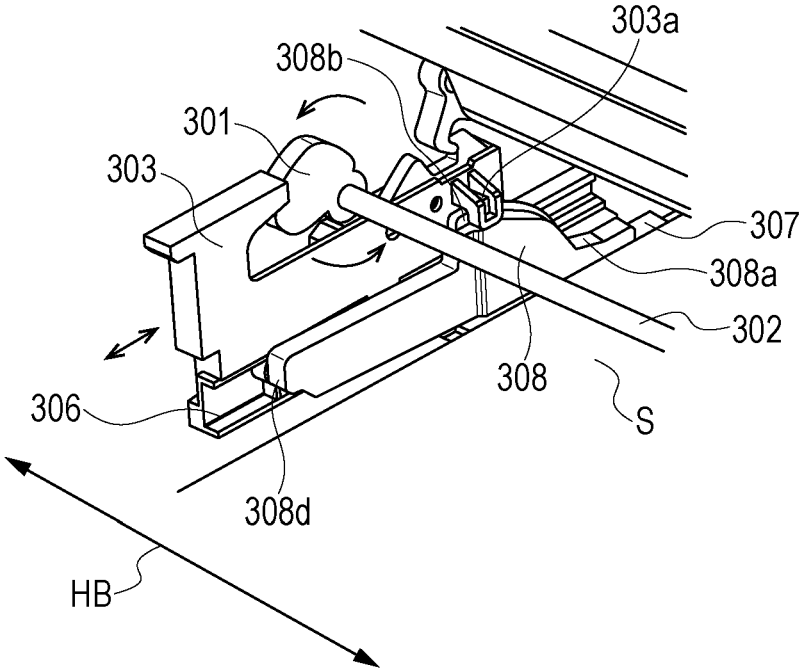
FIG. 15A is a perspective view of a lift mechanism according to another embodiment viewed from the inside.
Figure 16A:
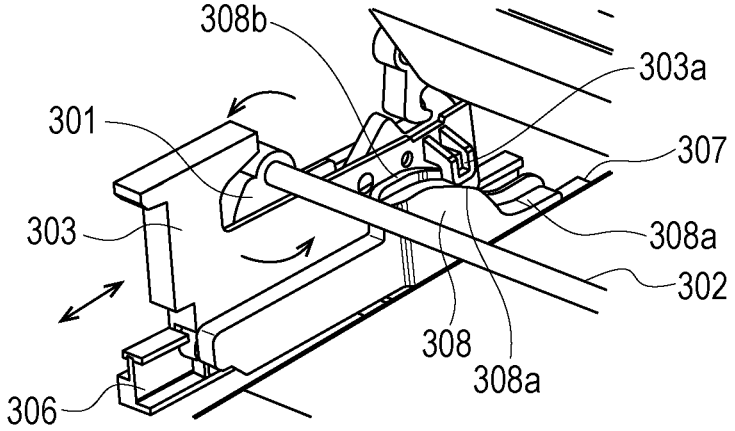
FIG. 16A is a perspective view of a lift mechanism according to another embodiment viewed from the inside.
Figure 16B:
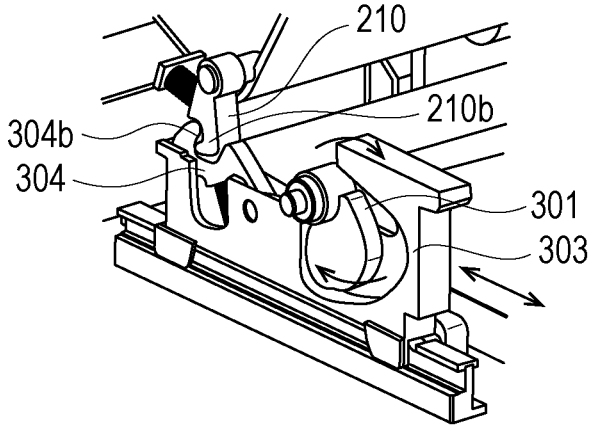
FIG. 16B is a perspective view of the lift member illustrated in FIG. 16A viewed from the opposite side (from the outside).
Figure 17A:
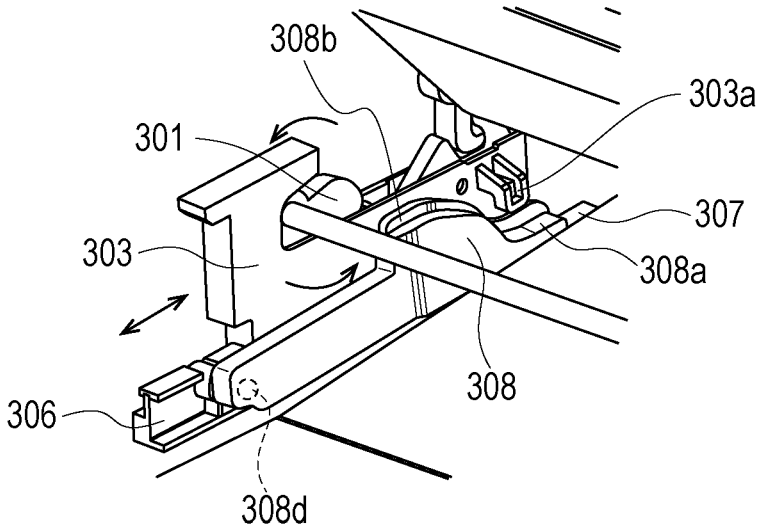
FIG. 17A is a perspective view of a lift mechanism according to another embodiment viewed from the inside.
Figure 17B:
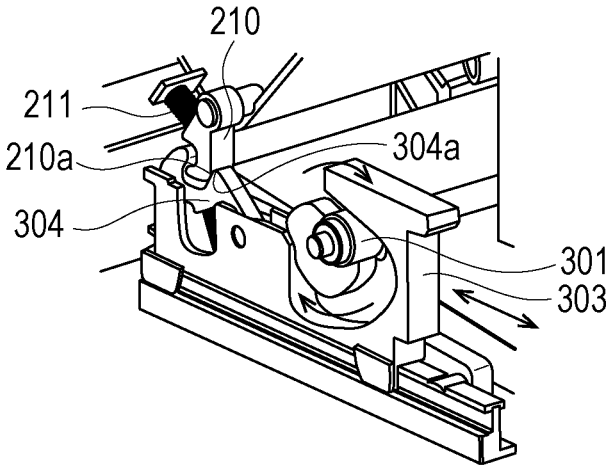
FIG. 17B is a perspective view of the lift member illustrated in FIG. 17A viewed from the opposite side (from the outside).

Referring to FIGS. 15A, 2, 16A, 6, 17A, and 9, a sheet feeding operation will be described. FIGS. 15A and 2 illustrate a state in which the lift plate 307 is positioned at a retracted position that is a position more retracted from the feed position with respect to the feed roller 102 so that the feed roller 102 is separated from the sheets stacked on the lift plate 307. FIGS. 16A and 6 illustrate a state in which the lift plate 307 is positioned at an intermediate position between the retracted position and the feed position, and FIGS. 17A and 9 illustrate a state in which the lift plate 307 is positioned at the feed position that is a position where the sheets stacked on the lift plate 307 is in pressure contact with the feed roller 102.

As illustrated in FIGS. 15A and 2, in the retracted position, the slider cam 303*a* provided in the slider 303 counters the urging force of the lift plate spring 309 and presses the cam follower 308, such that the uppermost sheet stacked on the lift plate 307 is spaced away from the feed roller 102. Specifically, it is a state in which the slider cam 303*a* abuts against the cam surface 308*a* of the cam follower 308. In such a state, a positioning surface 308*b* of the cam follower 308 and the slider cam 303*a* abut against each other. By having the slider cam 303*a* and the positioning surface 308*b* serving as a positioning portion abut against each other, the position of the cam follower 308 in the width direction is determined by the slider cam 303*a*. Since the lift plate 307 moves together with the cam follower 308 in an integrated manner, when the position of the cam follower 308 in the width direction is determined, the position of the lift plate 307 also is determined at the same time.

By having the position of the lift plate 307 be determined by the cam follower 308 and the slider cam 303*a*, the positional accuracy of a front end side of the lift plate 307 in a conveyance direction can be improved. By improving the positional accuracy of the lift plate 307 in the width direction, the pressure of the lift plate spring 309 that biases the lift plate 307 is applied to the lift plate 307 as a desired pressure, such that deformation and inclining of the lift plate 307 can be prevented. With the above, when the lift plate 307 is lifted, the state in which the feed roller 102 contacts the sheets S stacked on the lift plate 307 becomes stable such that the sheets S can be conveyed from the feed roller 102 in a stable manner.

However, when the position in the width direction is determined by the cam follower 308 when the lift plate 307 is lifted or lowered, the motion of the lift plate 307 is hindered. Accordingly, the present embodiment is configured so that the lifting and lowering of the lift plate 307 is performed in a smooth manner by changing the state in which the slider cam 303*a* is positioned with respect to the cam follower 308 in accordance with the lifting and lowering of the lift plate 307.

Figure 15B:
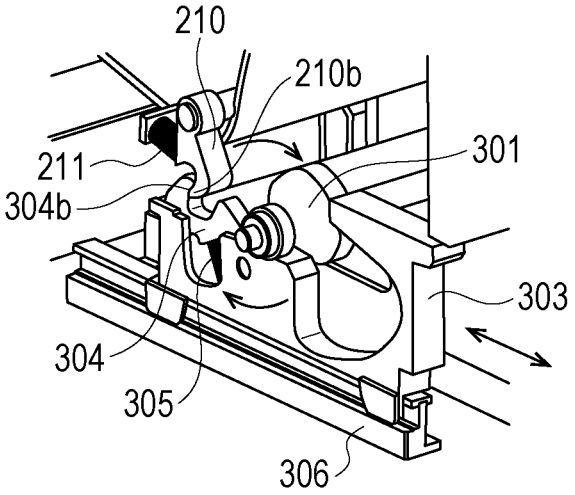
FIG. 15B is a perspective view of the lift member illustrated in FIG. 15A viewed from the opposite side (from the outside).

In a state illustrated in FIGS. 15A and 15B, when the separation cam 301 rotates, the slider 303 interlocking with the separation cam 301 slides. As illustrated in FIGS. 16A and 6, since the slider cam 303*a* provided in the slider 303 slides as well, the lift plate 307 pivots along the curved surface of the cam surface 308*a* of the cam follower 308. In so doing, as illustrated in FIG. 16A, the slider cam 303*a* is retracted with respect to the positioning surface 308*b* of the cam follower 308 with the sliding motion. With the sliding motion of the slider cam 303*a*, the abutted state between the positioning surface 308*b* and the slider cam 303*a* is cancelled. In other words, the region other than the positioning surface 308*b* of the cam follower 308 (the region other than the positioning portion) does not come in contact with the slider cam 303*a* of the slider 303.

When the separation cams 301 rotate further, the sliders 303 interlocking with the separation cams 301 slide. As illustrated in FIGS. 17A and 9, when the slider 303 moves to the end portion, the slider cam 303*a* and the cam follower 308 are spaced away from each other, and the pressing pressure of the lift plate 307 is released. As a result, the lift plate 307 biased with the lift plate spring 309 is lifted. The upper most sheet stacked on the lifted lift plate 307 comes into contact with the feed roller 102, such that a feedable feed position is reached. In so doing, since the positioning surface 308*b* and the slider cam 303*a* are in the separated state, the positioning surface 308*b* and the slider cam 303*a* can be prevented from interfering with each other when the lift plate 307 is lifted.

Figure 18:
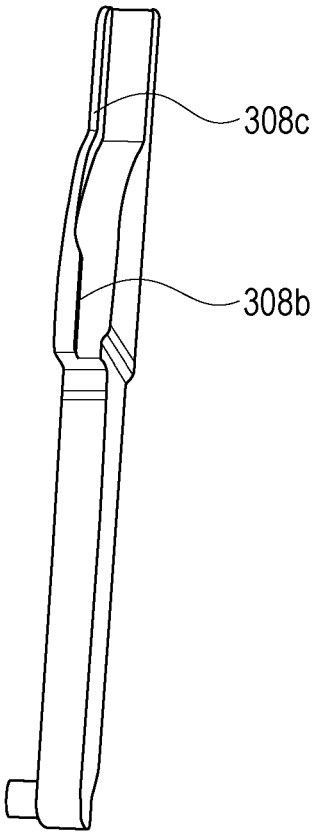
FIG. 18 is a top view of a contact member according to another embodiment viewed from above.

FIG. 18 is a top view of the cam follower 308 viewed from above. As illustrated in FIG. 18, the positioning surface 308*b* protrudes inwards in the width direction with respect to a retraction surface 308*c*, and abuts against the slider cam 303*a* when the lift plate 307 is positioned at the separated position.

Upon half a rotation of the separation cam 301 in the arrow direction from the feed position in FIGS. 17A and 9, the slider 303 interlocking with the separation cam 301 slides. The slider cam 303*a* countering the urging force of the lift plate spring 309 presses the cam follower 308, and the uppermost sheet stacked on the lift plate 307 is spaced away from the feed roller 102, such that the lift plate 307 is positioned at the retracted position illustrated in FIGS. 15A and 2.

Furthermore, by having the positioning surface 308*b* of the cam follower 308 abut against the slider cam 303*a* once more, the lift plate 307 is maintained at the separated position while in a state in which the position in the width direction has been determined.

Note that the sliders 303 are capable of performing a sliding motion in the lifting direction (the vertical direction in FIGS. 1 and 2) of the lift plate 307 in the space formed by the lift plate 307 and the feed roller 102.

In the present embodiment, since the position of the lift plate 307 in the width direction is determined by using the slider 303 and the cam follower 308 that restrict the lifting and lowering operation of the lift plate 307, the portions in which the position of the lift plate 307 is determined can be increased. Furthermore, since the slider 303 and the cam follower 308 that restricts the lifting and lowering operation of the lift plate 307 are used, a dedicated positioning member is not needed.

Furthermore, in the present embodiment, the lift plate 307 is lifted and lowered by changing the state in which the slider cam 303*a* of the slider 303 and the cam surface 308*a* are in contact with each other. Such a configuration allows the apparatus to be smaller in size when compared with a configuration in which the lifting and the lowering are performed by using a cam provided coaxial with the axis of rotation of the feed roller. In a case in which the pivoting operation of the lift plate 307 is performed using the cam that is coaxial with the axis of rotation of the feed roller, if the amount of sheets on the sheet feeding cassette were to be increased, a large cam will be required, and the sheet feeding apparatus 100 will become large in size. For example, by providing a large cam, the distance between the feed roller 102 and the conveyance roller 104 becomes large and the sheet feeding apparatus 100 becomes large in size.

Assuming that conditions such as the amount of stacked sheet on the sheet feeding cassette and the pivot angle of the lift plate 307 needed for such an amount are the same, compared with conventional configurations, the configuration of the present embodiment does not need a space where the cam coaxial with the axis of rotation of the feed roller operates, such that the size of the body in the height direction in particular can be reduced. Furthermore, as illustrated in FIGS. 1 and 2, and other figures, the region in which the sliders 303 perform the sliding motion is the space formed by the cartridge 200 and the lift plate 307, which is a space sufficient enough to dispose the sliders 303. Accordingly, a special space for disposing the sliders 303 is not required, and the printer body 1 defining the overall image forming apparatus can be prevented from becoming large in size.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-129044 filed Jun. 29, 2016 and No. 2016-144639 filed Jul. 22, 2016, which are hereby incorporated by reference herein in their entirety.

What is claimed is:

1. A sheet feeding apparatus comprising:

a sheet supporting member to support a sheet and is configured to be lifted and lowered;

a feeding member to feed the sheet stacked on the sheet supporting member;

a lift unit to lift the sheet supporting member such that the sheet stacked on the sheet supporting member is abutted against the feeding member, wherein the lift unit includes an urging member that surges the sheet supporting member towards the feeding member, a moving member that, with respect to the sheet supporting member, moves in a first direction that is a direction different from a lifting direction of the sheet supporting member, and a contact member that is supported by the sheet supporting member and is in contact with the moving member; and a rotatable separating member provided in the sheet feeding apparatus, wherein the moving member moves by rotation of the separating member, wherein the contact member includes a curved surface in a region that comes in contact with the moving member, wherein a contact state between the moving member and the contact member is changed by the curved surface, and wherein owing to the change in the contact state, the sheet supporting member is capable of moving to a feed position in which the sheet stacked on the sheet supporting member is abutted against the feeding member with the urging member, and capable of moving to a retracted position in which the sheet supporting member countering an urging force of the urging member is retreated more from the feeding member with respect to the feed position.

2. The sheet feeding apparatus according to claim 1, wherein the moving member performs a sliding motion in a horizontal direction that is the first direction.

3. The sheet feeding apparatus according to claim 2, wherein the moving member includes an action portion that acts on the curved surface, and wherein a position of the action portion is not changed in the lifting direction by the sliding motion.

4. The sheet feeding apparatus according to claim 3, wherein the action portion moves between the curved surface and the feeding member in a sheet feeding direction of the feeding member.

5. The sheet feeding apparatus according to claim 4, wherein the moving member performs a sliding motion between the sheet supporting member and the feeding member in the height direction.

6. The sheet feeding apparatus according to claim 1, wherein, in a case in which the sheet supporting member is positioned at the feed position, the curved surface of the contact member is spaced away from the contact member.

7. An image forming apparatus comprising:

the sheet feeding apparatus according to claim 1; and an image forming unit that forms an image on a sheet fed from the sheet feeding apparatus.

8. The image forming apparatus according to claim 7, wherein the image forming unit includes:

a photosensitive member on which an electrostatic latent image is formed, a developing member that develops the electrostatic latent image on the photosensitive member with toner, and an abutting and separating mechanism that abuts and separates the developing member with respect to the photosensitive member, wherein owing to the movement of the moving member, the abutting and separating mechanism abuts and separates the photosensitive member and the developing member against and from each other.

9. The image forming apparatus according to claim 8, wherein the moving member moves in a space between the image forming unit and the sheet supporting member.

10. The sheet feeding apparatus according to claim 1, wherein the sheet supporting member is configured to be lifted and lowered about an axis of rotation.

11. The sheet feeding apparatus according to claim 10, wherein, in a case in which the sheet supporting member is positioned at the feed position, the contact member and the moving member are spaced apart from each other.

12. The sheet feeding apparatus according to claim 11, wherein the contact member includes a positioning portion that comes in contact with the moving member and that performs positioning of the sheet supporting member in the width direction with the moving member, and wherein a region of the contact member other than the positioning portion does not come in contact with the moving member.

13. A sheet feeding apparatus comprising:

a sheet supporting member to support a sheet and is configured to be lifted and lowered;

a feeding member to feed the sheet stacked on the sheet supporting member;

a lift unit to lift the sheet supporting member such that the sheet stacked on the sheet supporting member is abutted against the feeding member, wherein the lift unit includes an urging member that surges the sheet supporting member towards the feeding member, a moving member that, with respect to the sheet supporting member, moves in a first direction that is a direction different from a lifting direction of the sheet supporting member, and a contact member that is supported by the sheet supporting member and is in contact with the moving member; and a rotatable separating member provided in the sheet feeding apparatus, wherein the moving member moves by rotation of the separating member, wherein the moving member includes a curved surface acting on the contact member in a region that comes in contact with the contact member, wherein a contact state between the moving member and the contact member is changed by the curved surface, and wherein owing to the change in the contact state, the sheet supporting member is capable of moving to a feed position in which the sheet stacked on the sheet supporting member is abutted against the feeding member with the urging member, and capable of moving to a retracted position in which the sheet supporting member countering an urging force of the urging member is retreated more from the feeding member with respect to the feed position.

14. The sheet feeding apparatus according to claim 13, wherein the moving member performs a sliding motion in a horizontal direction that is the first direction.

15. The sheet feeding apparatus according to claim 13, wherein the moving member performs a sliding motion between the sheet supporting member and the feeding member in the height direction.

16. An image forming apparatus comprising:

the sheet feeding apparatus according to claim 13; and an image forming unit that forms an image on a sheet fed from the sheet feeding apparatus.

17. The image forming apparatus according to claim 16, wherein the image forming unit includes:

a photosensitive member on which an electrostatic latent image is formed, a developing member that develops the electrostatic latent image on the photosensitive member with toner, and an abutting and separating mechanism that abuts and separates the developing member with respect to the photosensitive member, wherein owing to the movement of the moving member, the abutting and separating mechanism abuts and separates the photosensitive member and the developing member against and from each other.

18. The image forming apparatus according to claim 17, wherein the moving member moves in a space between the image forming unit and the sheet supporting member.

* * * * *